US008172226B2

(12) United States Patent
Murakami et al.

(10) Patent No.: US 8,172,226 B2
(45) Date of Patent: May 8, 2012

(54) SHEET CONVEYANCE DEVICE AND IMAGE FORMING APPARATUS

(75) Inventors: Ayumu Murakami, Abiko (JP); Haruhisa Oshida, Abiko (JP); Yuichi Yamamoto, Toride (JP); Yusuke Imai, Toride (JP); Kiyoshi Oyama, Tokyo (JP); Takuma Koizumi, Toride (JP); Toshifumi Itabashi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 1152 days.

(21) Appl. No.: 11/833,357

(22) Filed: Aug. 3, 2007

(65) Prior Publication Data

US 2008/0030810 A1 Feb. 7, 2008

(30) Foreign Application Priority Data

Aug. 7, 2006 (JP) ..... 2006-214666

(51) Int. Cl.
*B65H 5/00* (2006.01)

(52) U.S. Cl. ..... 271/264; 358/493; 358/496

(58) Field of Classification Search ..... 358/493, 358/496; 271/264
See application file for complete search history.

(56) References Cited

U.S. PATENT DOCUMENTS 5,168,310 A * 12/1992 Hayashi et al. ..... 399/215
6,034,784 A * 3/2000 Gatto et al. ..... 358/1.18
6,785,024 B1 * 8/2004 Corby et al. ..... 358/474
2004/0140606 A1 * 7/2004 Kobayashi et al. ..... 271/4.01
2005/0206069 A1 9/2005 Yamamoto ..... 271/117
2005/0225623 A1 * 10/2005 Hsieh et al. ..... 347/104
2006/0220305 A1 10/2006 Serizawa et al. ..... 271/262
2007/0116179 A1 * 5/2007 Spahn et al. ..... 378/98.8
2007/0273083 A1 11/2007 Imai ..... 271/152

FOREIGN PATENT DOCUMENTS

JP 6-135600 5/1994

OTHER PUBLICATIONS

T. Someya et al., "A Large-Area, Flexible, and Lightweight Sheet Image Scanner Integrated with Organic Field-Effect Transistors and Organic Photodiodes" [online], Electron Devices Meeting, 2004, IEDM Technical Digest, IEEE Internatioal, San Franciso, CA, Dec. 13-15, 2004 [retrieved on Sep. 26, 2011], retreived from http://ieeexplore.ieee.org/stamp/stamp.jsp?tp=&arnumber=1419159&tag=1.*

* cited by examiner

*Primary Examiner* — Michael McCullough

(74) *Attorney, Agent, or Firm* — Fitzpatrick, Cella, Harper & Scinto

(57) ABSTRACT

A sheet conveyance device has a sheet conveyance path formed by a guide member having a curved surface which is curved in a sheet conveyance direction, and a flexible sheet scanner is provided along the curved surface of the guide member, the flexible sheet scanner has an optical sensor layer in which photoelectric conversion devices formed by combinations of organic transistors and organic photodiodes are continuously arranged in a matrix shape.

10 Claims, 8 Drawing Sheets

SHEET CONVEYANCE DEVICE AND IMAGE FORMING APPARATUS

BACKGROUND OF THE INVENTION

1. Field of the Invention

The present invention relates to a sheet conveyance device for conveying a sheet and an image forming apparatus provided with the sheet conveyance device.

2. Description of the Related Art

Recently, in the image forming apparatus such as a printer and a copying machine, a position of the conveyed sheet is detected with high accuracy, a position of an image recorded in the sheet is adjusted based on the detection result, and accuracy of image recording position is improved with respect to the sheet.

Particularly, in a sheet conveyance path, plural sensors are arranged in a sheet conveyance direction and a sheet width direction orthogonal to the sheet conveyance direction to continuously measure the position of the sheet, which allows inclination of the sheet and a sheet conveyance speed to be detected in addition to the position of a sheet end portion (for example, see Japanese Patent Application Laid-Open No. 6-135600). The image recording position is adjusted with respect to the sheet based on the detection information, and whereby the accuracy of image recording position is improved.

However, downsizing of the image forming apparatus is progressing recently. Particularly in the case of a tandem type image forming apparatus in which color image can be recorded, there is a restriction in space where each component unit is installed in the apparatus. Therefore, most part of the sheet conveyance path connecting the component units are formed in a curved shape. It is difficult that the sensors for detecting the sheet position are continuously disposed in the sheet conveyance direction in the curved conveyance path. Therefore, the accuracy of image recording position is hardly improved in the case of the image forming apparatus in which most part of the conveyance paths are formed in the curved shape.

SUMMARY OF THE INVENTION

In view of the foregoing, the present invention continuously provides a sheet conveyance device and image forming apparatus to detect the sheet position in the sheet conveyance direction even in the curved sheet conveyance path to improve the accuracy of image recording position.

In order to achieve the object, a sheet conveyance device according to an aspect of the invention includes a sheet conveyance path formed by a guide member having a curved surface which is curved in a sheet conveyance direction, and a flexible sheet scanner, provided along the curved surface of the guide member, which detects the sheet conveyed on a sheet conveyance path, and the flexible sheet scanner has an optical sensor layer in which photoelectric conversion devices formed by combinations of organic transistors and organic photodiodes are continuously arranged in a matrix shape.

BRIEF DESCRIPTION OF THE DRAWINGS

FIG. 7 is an explanatory view illustrating a sheet scanner in which photoelectric conversion devices formed by combinations of organic semiconductor devices are continuously arranged.

DESCRIPTION OF THE EMBODIMENTS

Exemplary embodiments of the invention will be described in detail below with reference to the accompanying drawings. However, sizes, materials, and shapes of component and a relative arrangement of components described in the following embodiments should appropriately be changed according to a configuration and various conditions of an apparatus to which the invention is applied. Accordingly, the scope of the invention is not limited to the embodiments unless particularly stated.

A schematic configuration of an image forming apparatus will be described with reference to FIG. 6. The image forming apparatus illustrated in FIG. 6 is an in-line type full-color image forming apparatus in which an intermediate transfer member is used.

Figure 6:
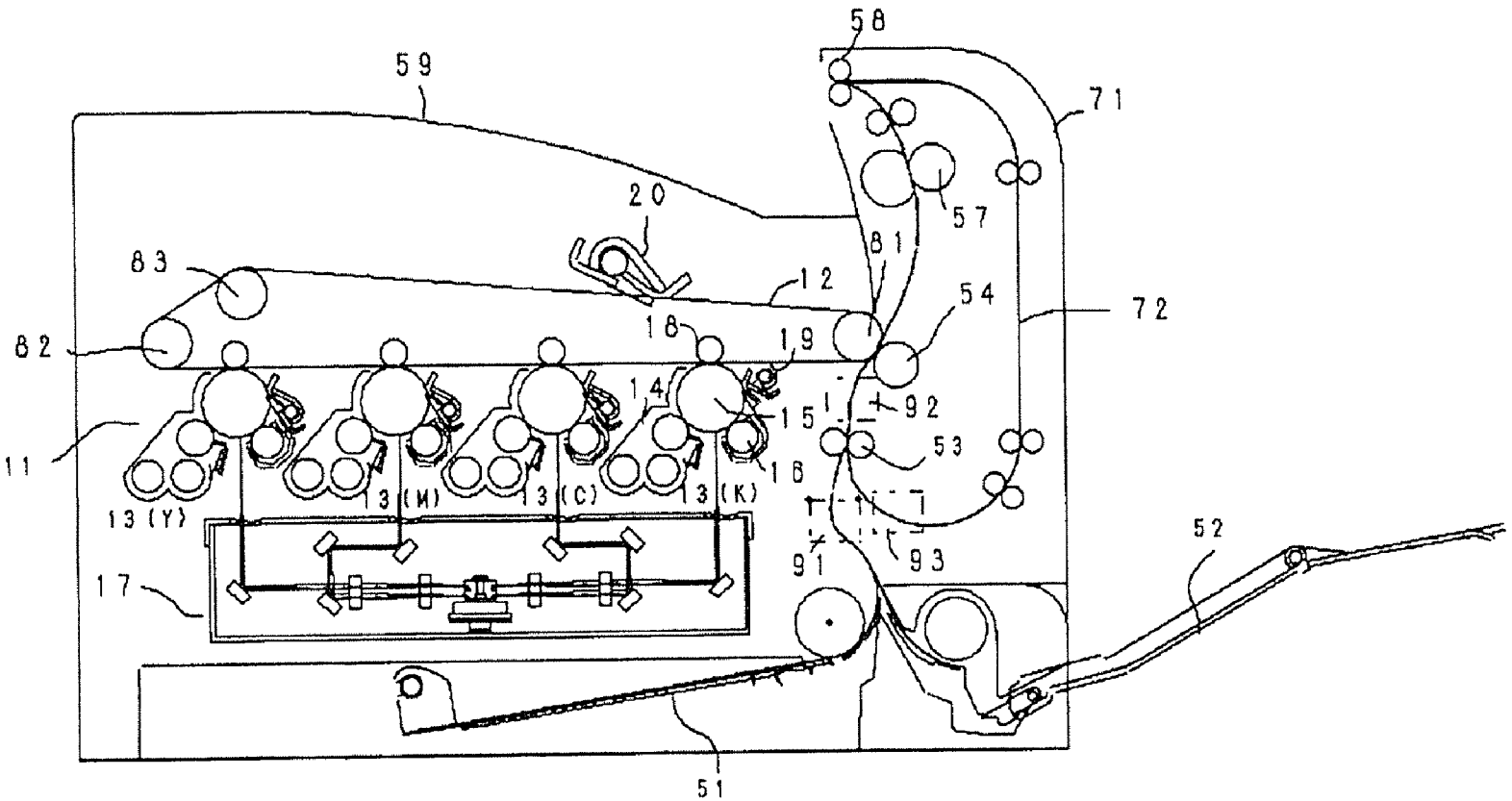
FIG. 6 is a sectional view illustrating a schematic configuration of an image forming apparatus having a curved sheet conveyance path.

In the image forming apparatus of FIG. 6, a sheet is selectively delivered from a sheet cassette 51 or a multi-sheet tray 52 is temporally stopped at a registration roller 53.

An ITB belt 12 which is of an intermediate transfer member is tensioned by a driving roller 81, a tension roller 82, and a driven roller 83.

In a peripheral portion between the rollers 81 and 82 of the ITB belt 12, four process units 13(Y), 13(M), 13(C), and 13(K) constituting an image forming portion 11 are sequentially provided from an upstream of a belt conveyance direction. Each process unit 13 is formed in each of color component of yellow (Y), magenta (M), cyan (C), and black (K).

Each process unit 13 is includes a development device 14 in which a toner having each color is stored and a photosensitive member 15 which is of an image forming body. The process units 13 have the same structure except for the color of the storage toner. In FIG. 6, the development device 14 and the photosensitive member 15 are shown only in the process unit 13(K), and the numerals of the development device and photosensitive member are neglected in other process units.

The photosensitive member 15 is rotated counterclockwise by power from a driving source (not shown). Although the configuration in which the photosensitive member 15 is rotated by the power from the driving source is illustrated in FIG. 6, the invention is not limited to the configuration of FIG. 6. For example, the photosensitive member 15 may be rotated by following the ITB belt 12.

A charging roller 16 which is of charging unit is attached to each photosensitive member 15 while facing the photosensitive member 15, and the charging roller 16 imparts an even potential to the photosensitive member 15. A cleaning device 19 which is of cleaning unit is attached to each photosensitive member 15 while facing the photosensitive member 15, and the cleaning device 19 recovers a residual transfer toner remaining on each photosensitive member 15 after transfer using a blade. The charging roller 16, the cleaning device 19, and the process unit 13 constitute an image forming portion 11, and the charging roller 16 and the cleaning device 19 are attached while facing the photosensitive member 15 of each process unit. In FIG. 6, the charging roller 16 and the cleaning device 19 are shown only in the process unit 13(K), and the numerals of the charging roller and cleaning device are neglected in other process units.

A laser scanner unit 17 emits a laser beam of each of the yellow (Y), magenta (M), cyan (C), and black (K) colors to each corresponding photosensitive member 15 according to image data to perform image exposure.

A latent image is formed according to the image data on the photosensitive member 15 to which the image exposure is performed by the laser scanner 17. Then, the development device 14 develops the latent image on each photosensitive member 15 using the toner. The toner image on each photosensitive member 15 is sequentially superposed on and transferred to the ITB belt 12 at the transfer position located between ITB belt 12 and the primary transfer roller 18. The ITB belt 12 and the primary transfer roller 18 face each other at the transfer position. The residual transfer toner remaining on each photosensitive member 15 after the transfer is cleaned by each cleaning device 19 which recovers the residual transfer toner using the blade.

At this point, the sheet which is temporally stopped at the registration roller 53 is conveyed at the timing of the toner image on the ITB belt 12 which is moved by the rotation of the ITB belt 12. The toner image is transferred onto the sheet by a secondary transfer roller 54 which faces the driving roller 81 while the ITB belt 12 is interposed therebetween. The residual transfer toner remaining on the ITB belt 12 after the transfer is cleaned by a cleaning device 20 which recovers the residual transfer toner using a blade. The sheet onto which the toner image is transferred is conveyed to a fixing device, and the fixing device 57 fixes the toner image onto the sheet.

Then, in the case of single-sided printing, the sheet onto which the toner image is fixed is directly discharged to a discharge tray 59 by a discharge roller 58.

In the case of duplex printing, the sheet onto which the toner image is fixed is conveyed to an inverting portion 71 by the discharge roller 58, and the sheet is delivered to the registration roller 53 again through a duplex path 72. Then, the sheet is conveyed at the timing of the toner image formed on the ITB belt 12 in the above-described manner, and a toner image is also transferred to a backside of the sheet by the secondary transfer roller 54. The toner image is fixed onto the by the sheet fixing device 57, and the sheet is discharged to the discharge tray 59 through the discharge roller 58.

A patch detection sensor (not shown) is provided on the ITB belt 12 to detect a patch of each color. Using detection information obtained by the patch detection sensor, the write timing of each process unit 13 of other colors with respect to a certain reference color is automatically adjusted such that the shift of the toner image transfer position of each process unit 13 to the ITB belt 12 is prevented.

Figure 1:
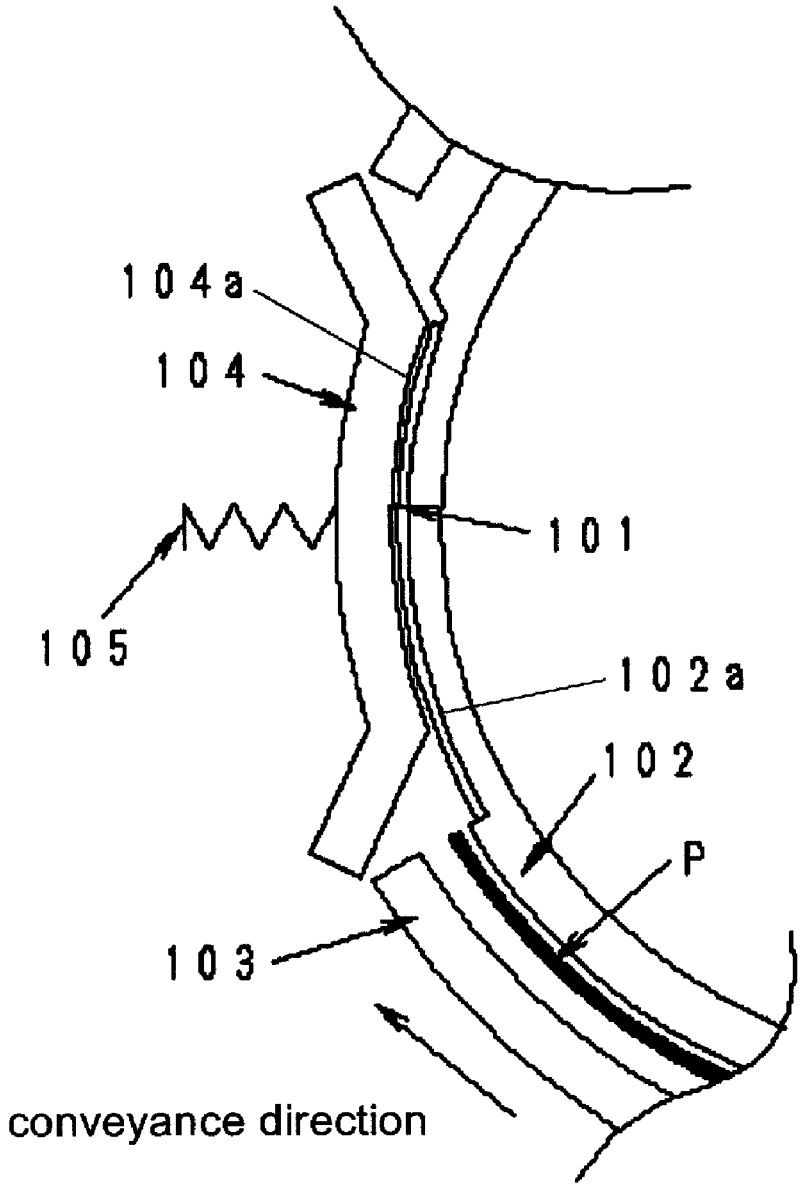
FIG. 1 is an enlarged sectional view illustrating a sheet scanner and a pressing member according to a first embodiment of the invention.

A sheet-shape scanner (hereinafter referred to as sheet scanner) which is used as detection unit for detecting the sheet is appropriately provided in the curved sheet conveyance path of the image forming apparatus. In the sheet conveyance path of the image forming apparatus of FIG. 6, the sheet scanners illustrated in FIG. 1 are provided in areas 91, 92, and 93 of FIG. 6.

In the curved sheet conveyance path, the areas 91, 92, and 93 where the sheet scanners are provided are illustrated only by way of example, the area where the sheet scanner is provided is not limited to the areas 91, 92, and 93. The area 91 indicates a delivery area 91 located on the upstream of the registration roller 53 in the sheet conveyance direction, the area 92 indicates a conveyance area 92 which is located on the downstream of the registration roller 53 and on the upstream of the position where the image is transferred to the sheet, and the area 93 indicates a re-delivery area 93 located on the upstream of the registration roller 53.

The sheet scanner which is of sheet detection unit will be described with reference to FIG. 7, and a configuration in the neighborhood of the sheet scanner in the curved sheet conveyance path will be described with reference to FIG. 1.

Recently, there has been proposed the sheet scanner in which an organic semiconductor device is used as a photoelectric conversion device. The sheet scanner has an optical sensor layer in which the photoelectric conversion devices formed by combinations of organic transistors and organic photodiodes are continuously arranged. For example, in the sheet scanner, a reading pixel which is of an optical sensor is formed on a plastic film by the combination of the organic transistor and the organic photodiode, and the reading pixels are arranged in a matrix shape, namely, the reading pixels are arranged in row and column directions. When the reading pixel (optical sensor) is irradiated with light, the organic photodiode generates electric current.

Figure 7A:
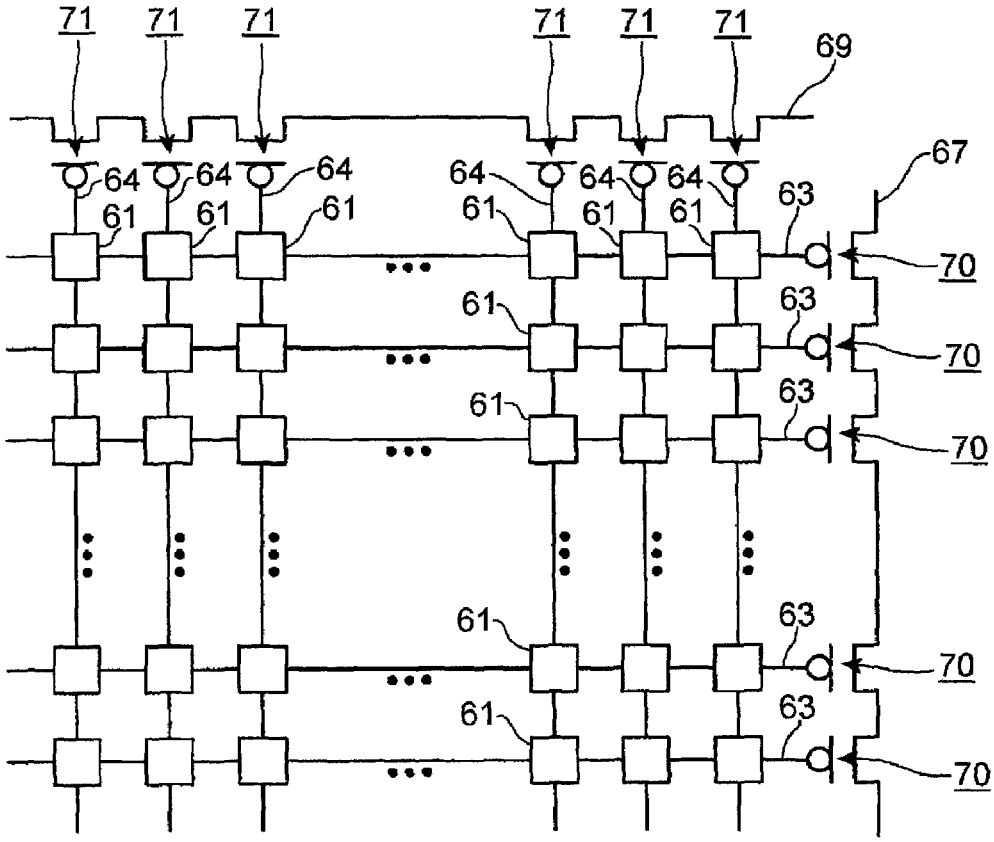
FIG. 7A is a schematic view describing a circuit configuration of the sheet scanner.
Figure 7B:
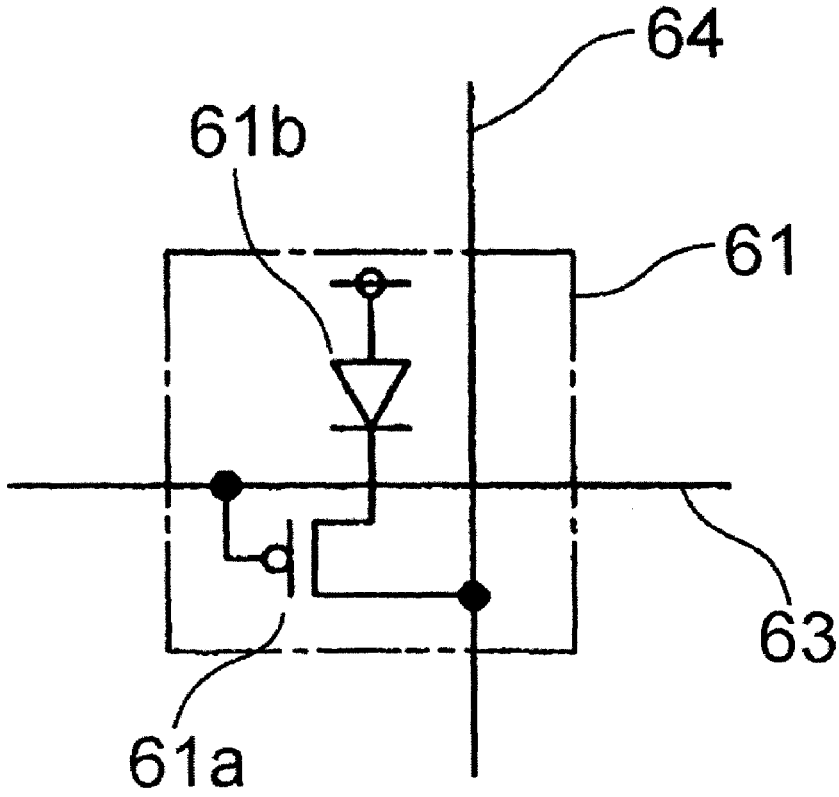
FIG. 7B is a schematic view describing a circuit diagram of each photoelectric conversion device.

FIG. 7 illustrates a mode of the sheet scanner. FIG. 7A is a schematic view describing a circuit configuration of the sheet scanner in which the optical sensors formed by the organic semiconductor devices are arranged in a matrix shape, and FIG. 7B is a schematic view describing a circuit configuration of each optical sensor.

Referring to FIG. 7A, reading pixels 61 arranged in one column line are connected to word lines 63 respectively, and the word lines 63 are connected to a column decode line 67 through word-line selectors 70. The reading pixels 61 arranged in one row line are connected to bit lines 64, and the bit lines 64 are connected to a row decode line 69 through bit-line selectors 71. A current of the predetermined reading pixel 61 is read by specifying addresses of the column decode line 67 and row decode line 69. A position (state) of the sheet located on the sheet scanner can be detected by reading the current of each reading pixel 61. Referring to FIG. 7B, each reading pixel 61 is formed by a combination of an organic transistor 61*a* and an organic photodiode 61*b*. In this case, the column direction is set to the sheet conveyance direction and the row direction is set to the sheet width direction orthogonal to the sheet conveyance direction.

The reading pixel and a peripheral circuit thereof are formed on a base-material sheet such as a flexible plastic film, and whereby an elastically bendable flexible sheet scanner is formed.

Referring to FIG. 1, conveyance guides 102 and 103 which are of the guide member for guiding the conveyed sheet, and the conveyance guides 102 and 103 are formed in the shape curved in the conveyance direction of the sheet P. The conveyance guides 102 and 103 constitute the curved sheet conveyance path. A sheet scanner 101 has the above configuration, the sheet scanner 101 is extremely thin (thickness is not more than 0.5 mm), and also has elasticity so that it may be flexibly bent. Therefore, the sheet scanner 101 can be used in the curved shape, and has extremely high usefulness. The sheet scanner 101 is formed in the flexible manner, so that the sheet scanner 101 can be provided in the curved shape along the curved surface of the conveyance guide. The sheet scanner 101 is bonded to a concave curved surface 102*a* of the conveyance guide 102 inside the curved sheet conveyance path using a bonding member such as a double-side adhesive tape.

In the first embodiment, the sheet scanner has the configuration in which the reading pixels are arranged in the base-material sheet. However, the invention is not limited to the first embodiment. In the sheet scanner, because the reading pixel which is of the photoelectric conversion device is formed by the organic semiconductor devices such as the organic transistor and the organic photodiode, the reading pixel can directly be formed on the conveyance guide by utilizing, e.g., a precise printing technique. Additionally, because the number of reading-pixel lines can arbitrarily and selectively be formed in the row or column direction, the one-line sensor array can easily be formed in the sheet conveyance direction. Because the reading pixels can be formed and arranged on the conveyance guide or the base-material sheet, even if the sheet conveyance path is curved as described above, the reading pixels can continuously be disposed along the conveyance path which being able to detect the sheet.

In the sheet scanner, the organic photodiode is emitted by itself and the reflected light is read. Therefore, a particular light source is not required in the sheet scanner 101.

In the curved conveyance path in which the sheet scanner 101 is provided, a pressing member 104 is provided to press the sheet P against the sheet scanner 101 in order to prevent flutter of the sheet P in the conveyance path. A biasing member 105 biases the pressing member 104 toward the direction in which the sheet is pressed against the sheet scanner 101.

At this point, the pressing member 104 presses the sheet P against the sheet scanner 101 using a pressing surface 104*a* having the same curved shape as the surface (curved surface 102*a*) of the conveyance guide 102 to which the sheet scanner 101 is bonded.

Therefore, the sheet P is conveyed while being in close contact with the sheet scanner 101 in both the sheet conveyance direction and the sheet width direction orthogonal to the sheet conveyance direction, which eliminates the generation of a reading error caused by the conveyance of the sheet P at the position where the sheet P is separated away from the sheet scanner 101.

The pressing surface (facing portion) 104*a* of the pressing member 104 is formed by a black resin member or the pressing surface 104*a* is configured such that the black resin film having a good sliding property is bonded to a surface of a resin member. When the sheet is not conveyed, the light emitted from the organic photodiode is not reflected by a black region of the pressing member 104 in the sheet scanner 101, so that a charge (current) accumulated in the organic transistor becomes a low level.

On the other hand, when the sheet P is conveyed between the sheet scanner 101 and the pressing member 104, the light reflected from the sheet P is incident to the organic transistor with respect to the light emitted from the organic photodiode, so that the charge (current) accumulated in the organic transistor becomes a high level.

The sheet scanner 101 can detect the presence or absence of the sheet according to the level of the charge accumulated in the organic transistor, and the charge accumulated in the organic transistor depends on the presence or absence of the sheet. Because the photoelectric conversion devices are arranged in the matrix shape in the sheet conveyance direction and sheet width direction on the sheet scanner 101, the presence or absence of the sheet can continuously be detected in each of the sheet conveyance direction and sheet width direction.

A position of a leading end, a rear end, or a side end of the sheet in the conveyance direction, a conveyance state such as sheet skew, and a sheet conveyance speed can be detected based on the obtained pieces of position data in the conveyance direction and width direction of the conveyed sheet and the time-series data thereof. For example, the position of the latent image exposed on the photosensitive member 15 can finely be adjusted by shifting or rotating the position of the latent image by a predetermined amount based on the detection information. The delivery timing performed by the registration roller 53 is adjusted, and a speed of the driving unit such as the registration roller 53, the secondary transfer roller 54, and the ITB belt 12 which are involved in the sheet conveyance speed is finely corrected. Therefore, the image can be recorded at a proper position with a proper magnification with respect to the sheet, and the accuracy of image recording position is improved.

The thin sheet scanner 101 having the elasticity is disposed in the conveyance guide 102 constituting the curved conveyance path, which allows plural sheet position detection unit to be continuously provided in the sheet conveyance direction and sheet width direction with space-saving.

The pressing member 104 is provided to press the conveyed sheet against the sheet scanner 101, which allows the detection error to be prevented. The sheet floats from the sheet scanner 101 due to the flutter of the sheet in the curved conveyance path, which causes the detection error.

The pressing surface 104*a* of the pressing member 104 is formed in the same curved shape as the curved surface 102*a* of the conveyance guide 102 provided in the sheet scanner 101, which allows the flutter of the sheet to be further prevented.

The pressing surface 104*a* of the pressing member 104 facing the sheet scanner 101 is blackened, which allows a difference of charge (current) accumulated in the sheet scanner 101 to be provided according to the presence or absence of the sheet to prevent the sheet detection error of the sheet scanner 101.

The sheet scanner 101 of the conveyance guide 102 in which the sheet scanner 101 is provided is formed in the concave shape, which conveys the sheet more smoothly.

Other embodiments which differ from the first embodiment will be described with reference to FIGS. 2 to 5. Other embodiments illustrated in FIGS. 2 to 5 will be described below. FIGS. 2 to 5 are enlarged sectional views illustrating the arrangement of the sheet scanner in the areas 91, 92, and 93 of the curved conveyance path in the image forming apparatus of FIG. 6.

Figure 2:
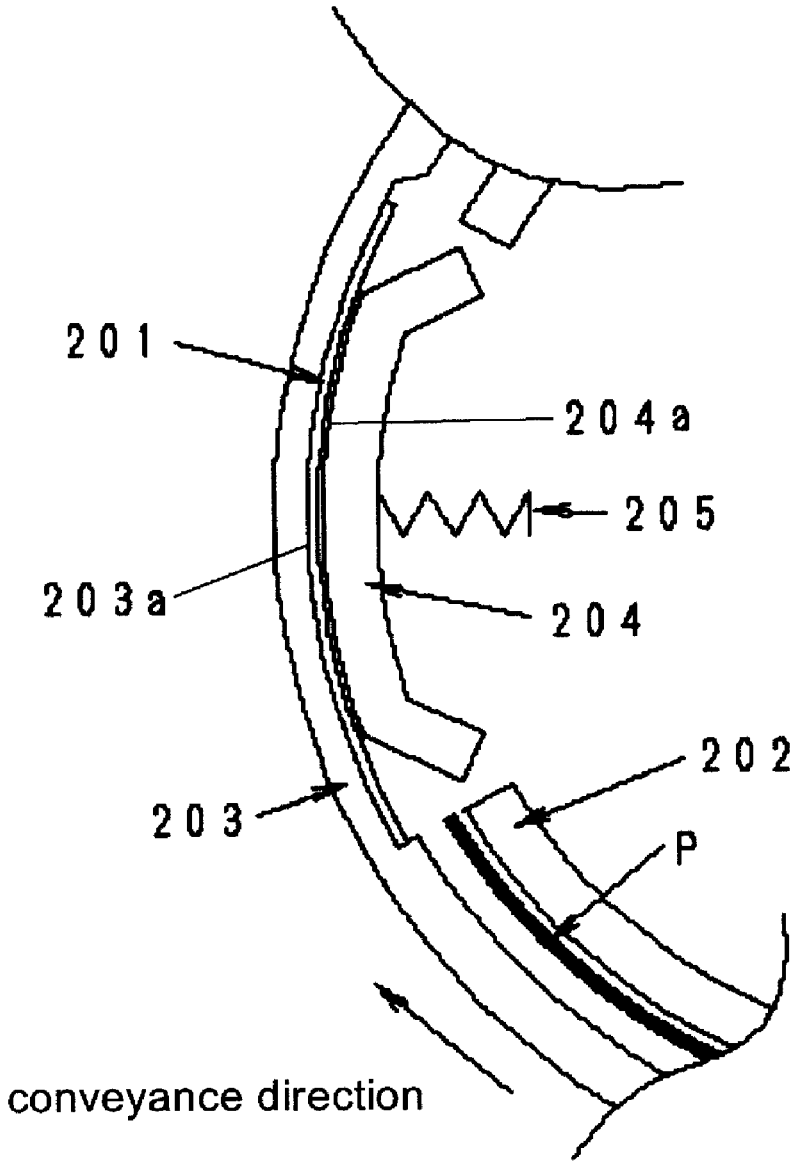
FIG. 2 is an enlarged sectional view illustrating a sheet scanner and a pressing member according to another embodiment of the invention.

Referring to FIG. 2, conveyance guides 202 and 203 which are of the guide member for guiding the conveyed sheet P, and the conveyance guides 202 and 203 are formed in the shape curved in the conveyance direction of the sheet P. The conveyance guides 202 and 203 constitute the curved sheet conveyance path. A sheet scanner 201 is a flexible sheet scanner (see FIG. 7) having the above configuration, the sheet scanner 201 is extremely thin (thickness is not more than 0.5 mm), and also has the elasticity so that it may be flexibly bent. In this case, the sheet scanner 201 is bonded to a concave curved surface 203*a* of the conveyance guide 203 outside the curved sheet conveyance path using a bonding member such as a double-side adhesive tape.

In the curved conveyance path in which the sheet scanner 201 is provided, a pressing member 204 is provided to press the sheet P against the sheet scanner 201 in order to prevent flutter of the sheet P in the conveyance path. A biasing member 205 biases the pressing member 204 toward the direction in which the sheet is pressed against the sheet scanner 201.

At this point, the pressing member 204 presses the sheet P against the sheet scanner 201 using a pressing surface 204*a* having the same curved shape as the surface (curved surface 203*a*) of the conveyance guide 203 to which the sheet scanner 201 is bonded.

Therefore, the sheet P is conveyed while being in close contact with the sheet scanner 201 in both the sheet conveyance direction and the sheet width direction orthogonal to the sheet conveyance direction, which eliminates the generation of the reading error caused by the conveyance of the sheet P at the position where the sheet P is separated away from the sheet scanner 201.

Particularly, in the configuration of FIG. 2, the conveyance guide 203 outside the conveyance path in which the sheet scanner 201 is provided receives a reaction force generated by rigidity of the sheet conveyed in the curved sheet conveyance path. Therefore, when compared with the configuration of FIG. 1 in which the sheet scanner is provided in the conveyance guide inside the conveyance pat, the flutter of the sheet can be prevented better, and the reading error caused by the flutter of the sheet can surely be prevented.

The pressing surface (facing portion) 204*a* of the pressing member 204 is formed by the black resin member or the pressing surface 204*a* is configured such that the black resin film having the good sliding property is bonded to the surface of the resin member. When the sheet is not conveyed, the light emitted from the organic photodiode is not reflected by a black region of the pressing member 204 in the sheet scanner 201, so that the charge (current) accumulated in the organic transistor becomes the low level.

On the other hand, when the sheet P is conveyed between the sheet scanner 201 and the pressing member 204, the light reflected from the sheet P is incident to the organic transistor with respect to the light emitted from the organic photodiode, so that the charge (current) accumulated in the organic transistor becomes the high level.

The sheet scanner 201 can detect the presence or absence of the sheet according to the level of the charge accumulated in the organic transistor, and the charge accumulated in the organic transistor depends on the presence or absence of the sheet. Because the photoelectric conversion devices are arranged in the matrix shape in the sheet conveyance direction and sheet width direction on the sheet scanner 201, the presence or absence of the sheet can continuously be detected in each of the sheet conveyance direction and sheet width direction.

Figure 3:
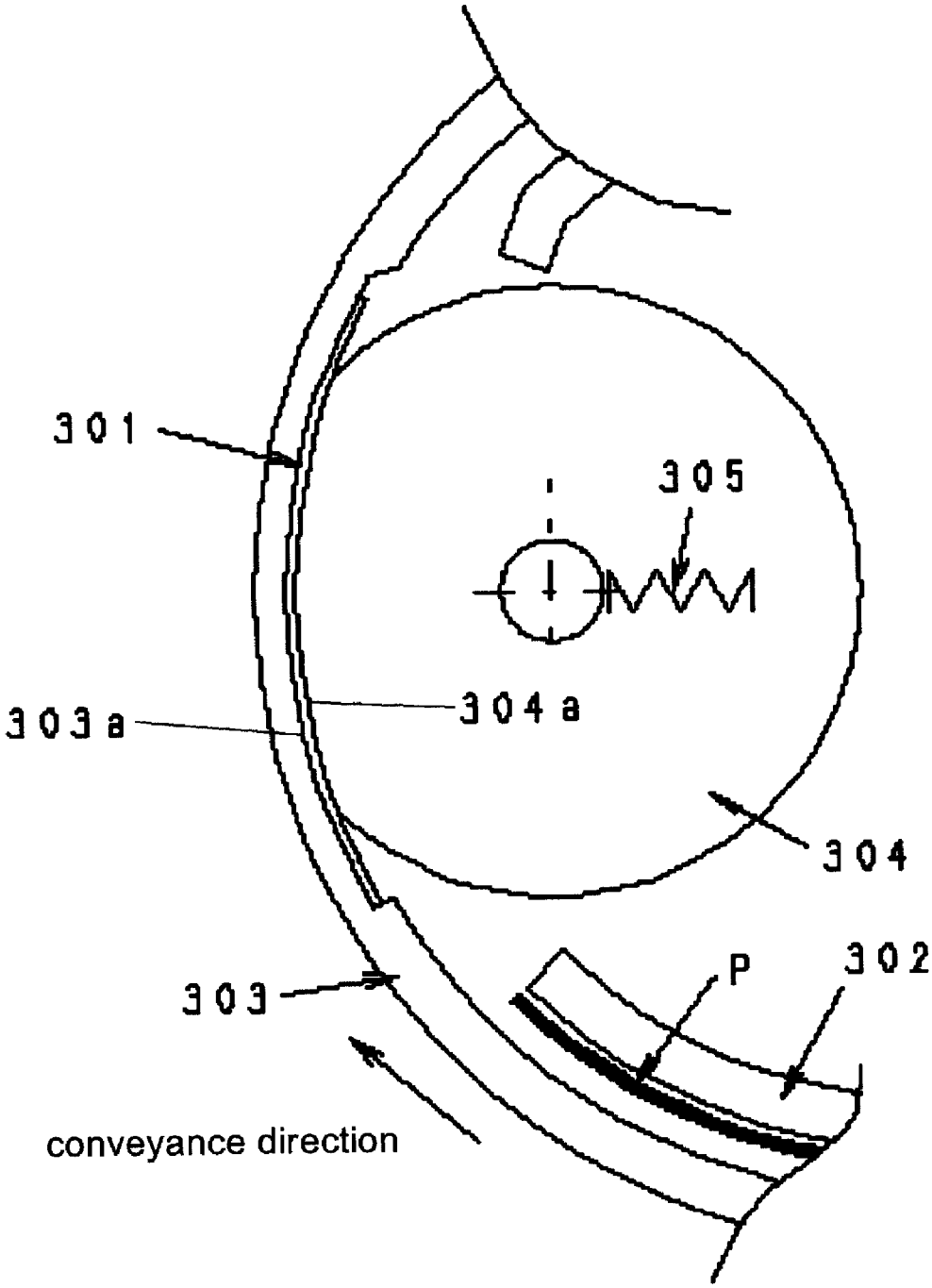
FIG. 3 is an enlarged sectional view illustrating a sheet scanner and a pressing member according to another embodiment of the invention.

Referring to FIG. 3, conveyance guides 302 and 303 which are of the guide member for guiding the conveyed sheet P, and the conveyance guides 302 and 303 are formed in the shape curved in the conveyance direction of the sheet P. The conveyance guides 302 and 303 constitute the curved sheet conveyance path. A sheet scanner 301 is a flexible sheet scanner (see FIG. 7) having the above configuration, the sheet scanner 301 is extremely thin (thickness is not more than 0.5 mm), and also has the elasticity so that it may flexibly bent. In this case, the sheet scanner 301 is bonded to the concave curved surface 303*a* of the conveyance guide 303 outside the curved sheet conveyance path using a bonding member such as the double-side adhesive tape.

In the curved conveyance path in which the sheet scanner 301 is provided, a pressing member 304 is provided to press the sheet P against the sheet scanner 301 in order to prevent flutter of the sheet P in the conveyance path. A biasing member 305 biases the pressing member 304 toward the direction in which the sheet is pressed against the sheet scanner 301.

The pressing member 304 is a rotary member formed by a foam sponge having elasticity, and the pressing member 304 is rotated by receiving drive from driving unit (not shown).

The pressing member 304 is elastically deformed by a biasing force of the biasing member 305, and a nip is formed between the pressing member 304 and the sheet scanner 301. The sheet scanner 301 detects the conveyed sheet in the nip. That is, the rotary member 304 having the elasticity is rotated while a pressing surface 304*a* having the same curved shape as the surface (curved surface 303*a*) of the conveyance guide 303 to which the sheet scanner 301 is bonded is formed by the elasticity of the rotary member 304 and the biasing force of the biasing member 305.

Therefore, the sheet P is conveyed while being in close contact with the sheet scanner 301 in both the sheet conveyance direction and the sheet width direction orthogonal to the sheet conveyance direction, which eliminates the generation of the reading error caused by the conveyance of the sheet P at the position where the sheet P is separated away from the sheet scanner 301.

Figure 4:
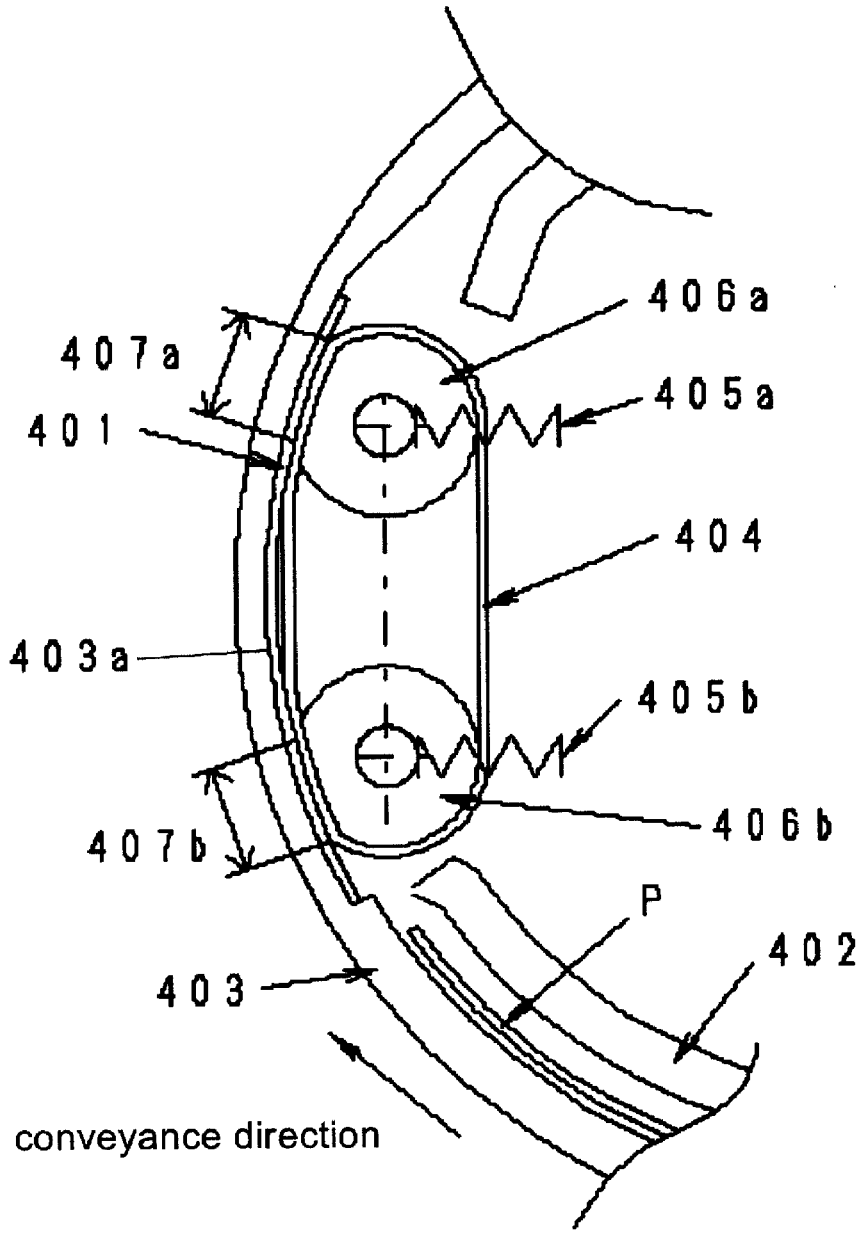
FIG. 4 is an enlarged sectional view illustrating a sheet scanner and a pressing member according to another embodiment of the invention.

Referring to FIG. 4, conveyance guides 402 and 403 which are of the guide member for guiding the conveyed sheet P, and the conveyance guides 402 and 403 are formed in the shape curved in the conveyance direction of the sheet P. The conveyance guides 402 and 403 constitute the curved sheet conveyance path. A sheet scanner 401 is a flexible sheet scanner (see FIG. 7) having the above configuration, the sheet scanner 401 is extremely thin (thickness is not more than 0.5 mm), and also has the elasticity so that it may flexibly bent. In this case, the sheet scanner 401 is bonded to a concave curved surface 403*a* of the conveyance guide 403 outside the curved sheet conveyance path using the bonding member such as the double-side adhesive tape.

In the curved conveyance path in which the sheet scanner 401 is provided, a pressing member 404 is provided to press the sheet P against the sheet scanner 401 in order to prevent flutter of the sheet P in the conveyance path.

The pressing member 404 is formed by an endless belt member, and the pressing member 404 is tensioned by pressing assist members 406*a* and 406*b* having elasticity. Biasing members 405*a* and 405*b* bias the pressing assist members 406*a* and 406*b* toward the direction in which the sheet is pressed against the sheet scanner 402. The pressing member 404 is rotated by receiving the drive from driving unit (not shown) through one of both the pressing assist members 406*a* and 406*b*.

The pressing member 404 is elastically deformed by biasing forces of the biasing members 405*a* and 405*b*, and nips 407*a* and 407*b* are formed between the pressing member 404 and the sheet scanner 401. That is, the belt member 404 is rotated by the biasing force of the biasing member 305 while elastically deformed in the track of the surface (curved surface 403*a*) of the facing conveyance guide 403 to which the sheet scanner 401 is bonded.

Therefore, the sheet P is conveyed while being in close contact with the sheet scanner 401 in both the sheet conveyance direction and the sheet width direction orthogonal to the sheet conveyance direction, which eliminates the generation of the reading error caused by the conveyance of the sheet P at the position where the sheet P is separated away from the sheet scanner 401.

Figure 5:
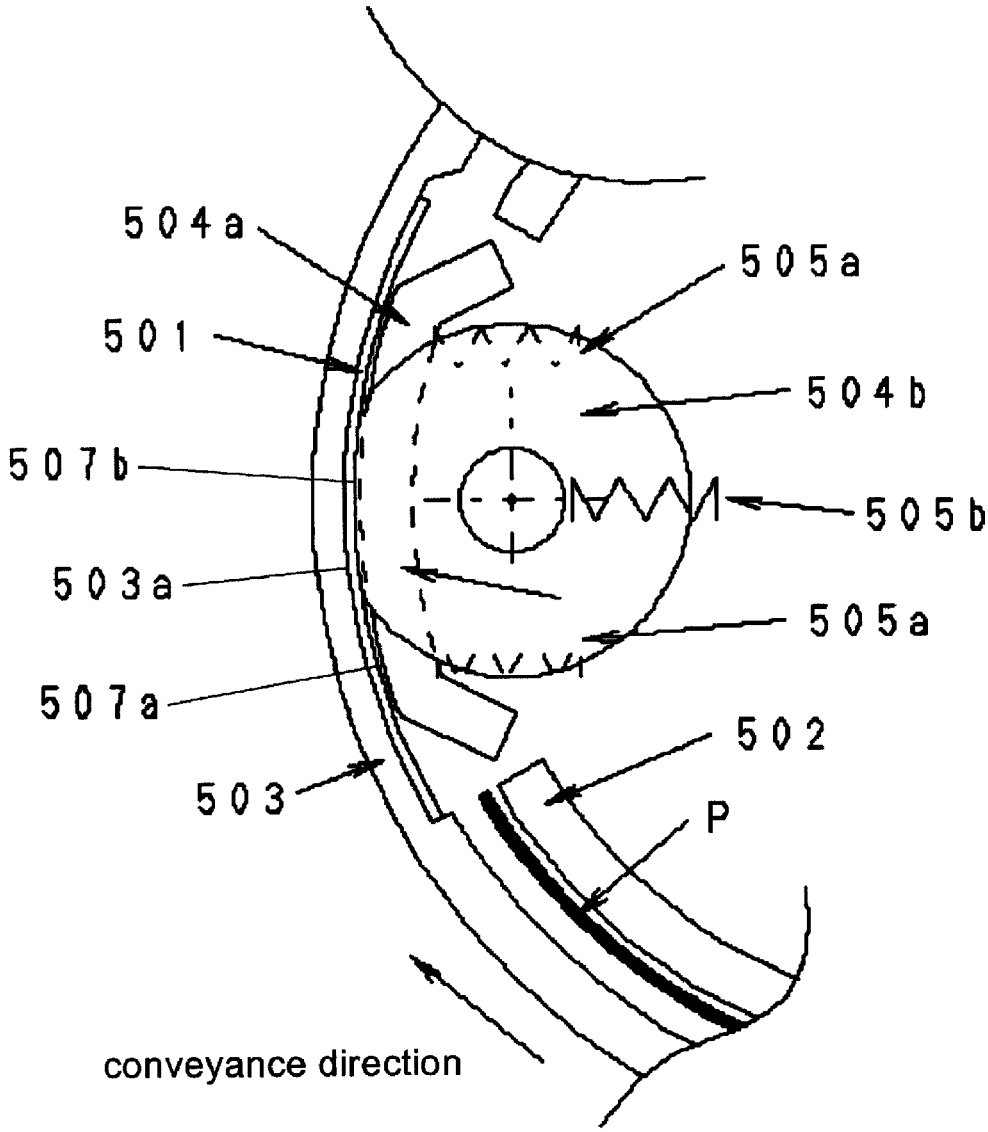
FIG. 5 is an enlarged sectional view illustrating a sheet scanner and a pressing member according to another embodiment of the invention.

Referring to FIG. 5, conveyance guides 502 and 503 which are of the guide member for guiding the conveyed sheet P, and the conveyance guides 502 and 503 are formed in the shape curved in the conveyance direction of the sheet P. The conveyance guides 502 and 503 constitute the curved sheet conveyance path. A sheet scanner 501 is a flexible sheet scanner (see FIG. 7) having the above configuration, the sheet scanner 501 is extremely thin (thickness is not more than 0.5 mm), and also has the elasticity so that it may be flexibly bent. In this case, the sheet scanner 501 is bonded to a concave curved surface 503*a* of the conveyance guide 503 outside the curved sheet conveyance path using the bonding member such as the double-side adhesive tape.

In the curved conveyance path in which the sheet scanner 501 is provided, pressing members 504*a* and 504*b* are provided to press the sheet P against the sheet scanner 501 in order to prevent flutter of the sheet P in the conveyance path.

The first pressing member 504*a* has a pressing surface 507*a* having the same curved shape as the surface (curved surface 503*a*) to which the sheet scanner 501 is bonded to the conveyance guide 503, and a biasing member 505*a* biases the first pressing member 504*a* toward the direction in which the sheet P is pressed against the sheet scanner 501. Accordingly, the pressing member 504*a* presses the sheet P against the sheet scanner 501 in the pressing surface 507*a*.

The second pressing member 504*b* is a rotary member formed by the foam sponge having the elasticity, and the second pressing member 504*b* is rotated by receiving the drive from driving unit (not shown). The rotary member 504*b* is biased toward the direction in which the sheet is pressed against the sheet scanner 501 by a biasing member 507*b*.

The pressing member 504*b* is elastically deformed by a biasing force of the biasing member 505*b*, and a nip is formed between the pressing member 504*b* and the sheet scanner 501. The sheet scanner 501 detects the conveyed sheet in the nip. That is, the rotary member 504*b* having the elasticity is rotated while a pressing surface 504*b* having the same curved shape as the surface (curved surface 503*a*) of the conveyance guide 503 to which the sheet scanner 501 is bonded is formed by the elasticity of the rotary member 504*b* and the biasing force of the biasing member 505*b*.

Therefore, the sheet P is conveyed while being in close contact with the sheet scanner 501 in both the sheet conveyance direction and the sheet width direction orthogonal to the sheet conveyance direction, which eliminates the generation of the reading error caused by the conveyance of the sheet P at the position where the sheet P is separated away from the sheet scanner 501.

In the embodiments of FIGS. 1 to 5, the curved surface to which the sheet scanner is bonded is formed in a C-shape. However, the invention is not limited to a C-shape. For example, the invention can be applied to curved surfaces having different shapes such as an S-shape.

Although the printer is illustrated as the image forming apparatus in the above embodiments, the invention is not limited to the printer. Examples of the image forming apparatus include a scanner, a copying machine, a facsimile, and a multifunction peripheral in which these functions are combined. The same effects can be obtained by applying the invention to the sheet conveyance device used in these pieces of image forming apparatus.

Although the sheet conveyance device is integral with the image forming apparatus in the above embodiment, the invention is not limited to the above embodiments. For example, the sheet conveyance device may be detachably attachable to the image forming apparatus, and the same effect can be obtained by applying the invention to the sheet conveyance device.

Although the sheet conveyance device for conveying the sheet such as the recording paper of the recording target is illustrated in the above embodiments, the invention is not limited to the above embodiments. For example, the same effects can be obtained by applying the invention to the sheet conveyance device for conveying the sheet such as the original of the read target to the image forming apparatus.

This application claims the benefit of priority from the prior Japanese Patent Application No. 2006-214666 filed on Aug. 7, 2006 the entire contents of which are incorporated by reference herein.

What is claimed is:

1. A sheet conveyance device comprising;

a sheet conveyance path formed by a guide member comprising conveyance guides having curved surfaces, the curved surfaces being curved in a sheet conveyance direction, a flexible sheet scanner, provided in a curved shape along at least one of the curved surfaces of the guide member, which detects the sheet conveyed on a sheet conveyance path, the flexible sheet scanner having an optical sensor layer in which photoelectric conversion devices formed by combinations of organic transistors and organic photodiodes are continuously arranged in a matrix shape; and a pressing member provided to press the conveyed sheet against the sheet scanner so as to convey the sheet along the sheet scanner.

2. The sheet conveyance device according to claim 1, wherein the sheet scanner is provided in one of a conveyance guide of the guide member disposed inside the curved sheet conveyance path and a conveyance guide of the guide member disposed outside the curved sheet conveyance path.

3. The sheet conveyance device according to claim 1, wherein a portion facing the sheet scanner is blackened in the pressing member.

4. The sheet conveyance device according to claim 1, wherein a pressing surface of the pressing member for pressing the sheet against the sheet scanner has substantially the same curved shape as one of the curved surfaces of the facing guide member.

5. The sheet conveyance device according to claim 1, wherein the pressing member is a rotary member having elasticity.

6. The sheet conveyance device according to claim 1, wherein the pressing member is formed by an endless belt member tensioned by a plurality of pressing assist members having elasticity.

7. The sheet conveyance device according to claim 1, wherein the pressing member includes a first pressing member and a second pressing member, the first pressing member having a pressing surface which presses the sheet against the sheet scanner has substantially the same curved shape as a curved surface of the facing guide member, the second pressing member being a rotary member having elasticity.

8. The sheet conveyance device according to claim 1, wherein a curved surface in which the sheet scanner is provided is a concave curved surface in the guide member.

9. An image forming apparatus comprising;

a sheet conveyance path formed by a guide member comprising conveyance guides having curved surfaces, the curved surfaces being curved in a sheet conveyance direction, the sheet conveyance path guiding a sheet on which an image is already formed, and a flexible sheet scanner, provided in a curved shape along the curved surfaces of the guide member, which detects the sheet conveyed on a sheet conveyance path, and the flexible sheet scanner has an optical sensor layer in which photoelectric conversion devices formed by combinations of organic transistors and organic photodiodes are continuously arranged in a matrix shape; and a pressing member provided to press the conveyed sheet against the sheet scanner so as to convey the sheet along the sheet scanner.

10. An image reading apparatus comprising;

a sheet conveyance path formed by a guide member comprising conveyance guides having curved surfaces, the curved surfaces being curved in a sheet conveyance direction, the sheet conveyance path guiding an original, and a flexible sheet scanner, provided in a curved shape along the curved surfaces of the guide member, which detects the sheet conveyed on a sheet conveyance path, and the flexible sheet scanner has an optical sensor layer in which photoelectric conversion devices formed by combinations of organic transistors and organic photodiodes are continuously arranged in a matrix shape; and a pressing member is provided to press the conveyed sheet against the sheet scanner so as to convey the sheet along the sheet scanner.

* * * * *